US006234162B1

(12) United States Patent
Wenker

(10) Patent No.: US 6,234,162 B1
(45) Date of Patent: May 22, 2001

(54) OPEN FIRE COOKING APPARATUS

(76) Inventor: David Allen Wenker, 5834 325th St. Oxford Estate, Cannon Falls, MN (US) 55009

( * ) Notice: Subject to any disclaimer, the term of this patent is extended or adjusted under 35 U.S.C. 154(b) by 0 days.

(21) Appl. No.: 09/595,644

(22) Filed: Jun. 16, 2000

(51) Int. Cl.[7] ..... F24B 3/00

(52) U.S. Cl. ..... 126/29; 126/30; 99/421 H; 30/323

(58) Field of Search ..... 126/29, 30, 25 R, 126/9 R, 41 A, 41 B, 9 B, 41 C, 25 AA; 30/323, 322, 142; 99/427, 441, 421 H

(56) References Cited

U.S. PATENT DOCUMENTS

| | | | | |
|---|---|---|---|---|
| 2,136,658 | * | 11/1938 | Westberg et al. | 126/30 |
| 2,522,223 | * | 9/1950 | Hardin et al. | 126/30 |
| 2,535,548 | * | 12/1950 | Porter | 99/421 A |
| 2,864,163 | * | 12/1958 | Boruvka | 126/9 B |
| 2,935,982 | | 5/1960 | Otis . | |
| 2,938,450 | * | 5/1960 | Carpenter et al. | 126/9 B |
| 2,938,988 | * | 5/1960 | McCutcheon et al. | 126/25 R |
| 3,013,551 | * | 12/1961 | Savino | 126/29 |
| 3,802,330 | * | 4/1974 | Graziani | 126/25 R |
| 3,931,758 | * | 1/1976 | Blakc | 99/421 |
| 3,946,653 | | 3/1976 | Pugh . | |
| 4,083,354 | | 4/1978 | Claire et al. . | |
| 4,094,296 | | 6/1978 | Beagley . | |
| 4,517,885 | * | 5/1985 | Thompson | 99/421 |
| 4,539,751 | * | 9/1985 | Chan | 30/322 |
| 4,553,525 | | 11/1985 | Ruble . | |
| 4,691,626 | * | 9/1987 | Shih-Cheng | 99/421 |
| 4,985,607 | * | 1/1991 | Oya | 99/421 H |
| 5,117,558 | * | 6/1992 | Hull | 99/421 |
| 5,206,998 | * | 5/1993 | Oriente et al. | 30/322 |
| 5,749,286 | * | 5/1998 | Payette | 30/323 |
| 5,944,009 | | 8/1999 | Scheller . | |

* cited by examiner

*Primary Examiner*—Ira S. Lazarus
*Assistant Examiner*—David Lee
(74) *Attorney, Agent, or Firm*—Moore & Hansen

(57) ABSTRACT

An apparatus for cooking food items over an open fire which allows a cook to turn the food and adjust the position of the food over the fire while maintaining a safe distance from the fire. The apparatus is constructed and arranged to allow hands-free operation or, if desired, allow a cook to continually control the position of the food over the fire using one hand. This is accomplished using a telescopic handle and two supports.

9 Claims, 1 Drawing Sheet

OPEN FIRE COOKING APPARATUS

BACKGROUND OF THE INVENTION

Camping and many similar outdoor activities inevitably involve the task of cooking over an open fire. Unless a grate is provided over the fire pit, this task can become tricky and often reduces the menu to items which can be speared with a stick and held over the fire.

Solutions presently available in stores comprise little more than a rectangular, stainless steel cage with a handle. The items to be cooked are placed in the cage, and the cage is closed and held by hand over the fire. This not only creates extreme fatigue, as the chef must perform lengthy isometric exercises in order to keep the food in proper position over the fire, it requires the chef remain in close proximity to the fire.

There have been attempted solutions to this problem which have been patented but have never enjoyed success in the marketplace for various reasons. For instance, U.S. Pat. No. 2,935,982, which issued to Otis on May 10, 1960, discloses two vertical support members and a horizontal support member, all of which are made from a heavy metal wire material. The device described therein is impractical in that it does not provide the necessary flexibility required by proper cooking techniques. For example, once set up, the device does not allow the chef to relocate the food over a different portion of the campfire. Nor does it allow the chef to back away from the campfire in order to avoid the heat from a growing fire or a change in winds. Also, the flimsy wire material would have a propensity to bend and wobble if used for cooking a heavy food item such as a large steak. Finally, the device does not allow the chef to flip the food over without getting close to the fire.

It would be advantageous to provide an open fire cooking apparatus which is solid, strong, and has the functional flexibility to allow the chef to reposition the food, and him or herself, while the food is being prepared.

SUMMARY OF THE INVENTION

The present invention relates to an open fire cooking apparatus comprising a handle having a first end and a second end which are separated by a distance defined as the length of the handle. The handle is constructed and arranged to removably accept a variety of cooking platforms proximate its first end. Preferably, the handle is telescopically arranged with a first and second handle member, said members arranged substantially concentric with each other such that one member is partially slidably housed within the other, allowing the length of the handle to be adjustable. It is envisioned that the handle have more than two members to allow a greater length range along with relatively compact storage when the members are housed within each other. Preferably the handle has a substantially circular cross section.

The handle and cooking platform are elevated above the ground and fire, respectively, by a first support and a second support. It is preferable that the first support comprise at least one, preferably two legs, having pointed lower ends for insertion into the ground. It is even more preferable that these legs be separated and connected by a substantially horizontal cross member. The cross member is advantageous, not only because it adds stability and rigidity to the first support, but because it provides a place for a user to place his or her foot in order to push the support legs into the ground. The legs are joined at their upper ends, preferably by a second cross member, which carries a handle holding mechanism. The first handle holding mechanism cradles the handle and provides vertical, upward support, as well as lateral support. Preferable, the first handle holding mechanism comprises a upwardly opening, U-shaped bracket. More preferably, the first handle holding mechanism comprises a resiliently biased clip which forcibly holds the handle in place.

The second support may be constructed and arranged like the first support, but preferably comprises a telescoping support member, partially and concentrically housed in a hollow center body having a tightening mechanism for fixing the variable support member at a predetermined height. A plurality of legs, preferably three, radiate from the center body and are angularly separated by interior angles $\alpha$, $\beta$, and $_{\gamma}$. Angles $\alpha$, $\beta$, and $\gamma$ are preferably at least 60° each, more preferably on the order of 120° each. A second handle holding mechanism is attached to the top of the telescoping support member. The second handle holding mechanism is preferably a resiliently biased mechanism, similar to that of the first support. Alternatively, because the second handle holding mechanism will be required to exert a downward force on the handle, especially when the cooking platform is weighted down with food, thereby causing the handle to become a lever and the first support to act as a fulcrum, second handle holding mechanism could comprise a downwardly opening bracket, attached at one end of the opening to the telescoping support member.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

DETAILED DESCRIPTION

Figure 1:
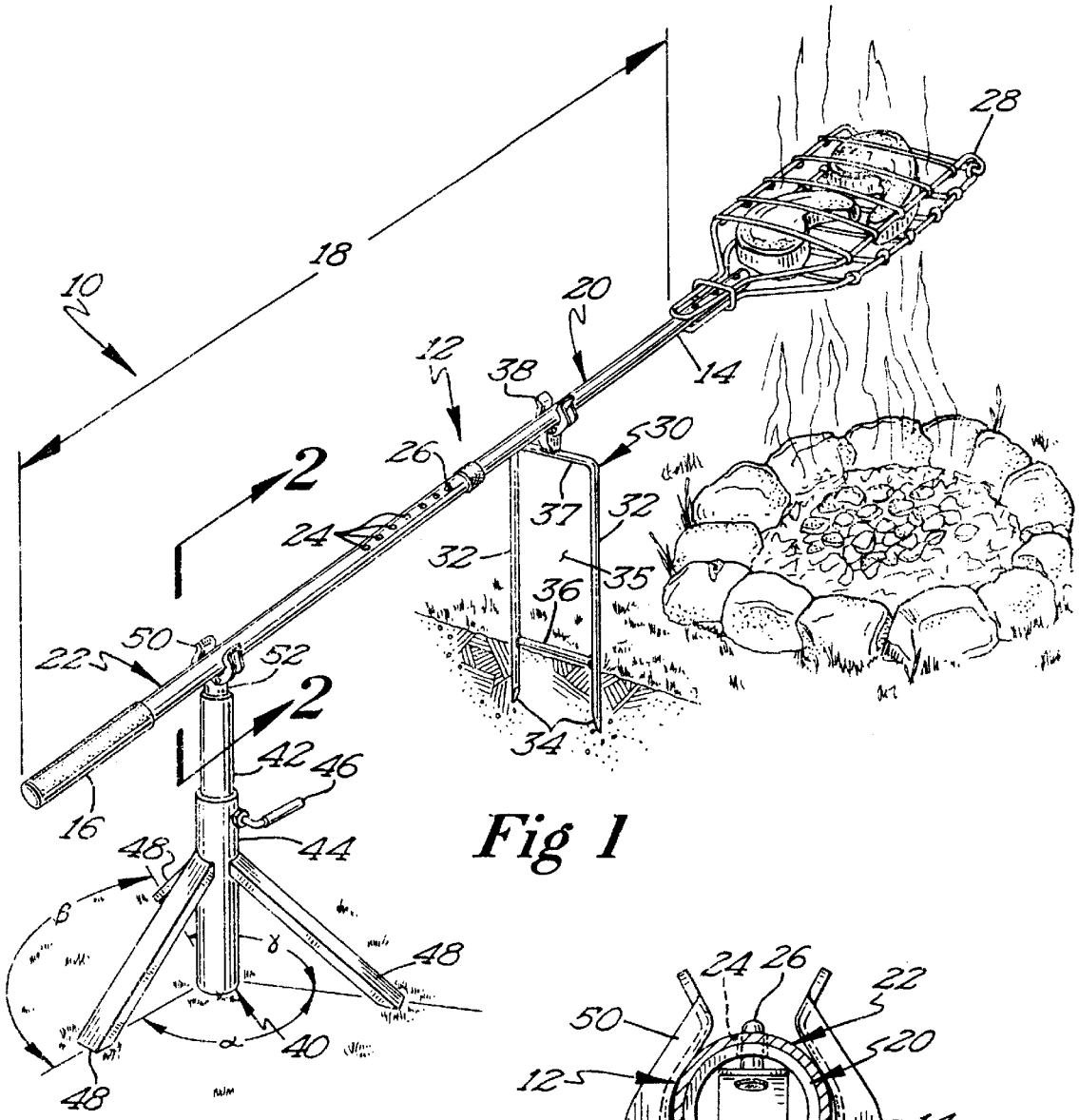
FIG. 1 is a perspective view of the present invention in operation over an open fire; and, FIG. 2 is a cross section taken generally along lines 2—2 of FIG. 1.
Figure 2:
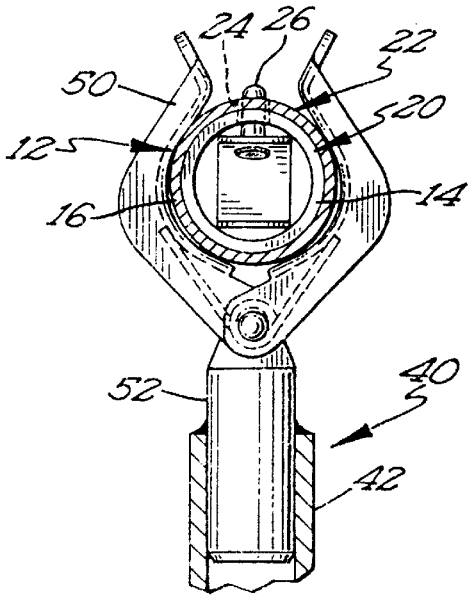

Referring now to the drawings, and first to FIG. 1, there is shown an apparatus 10 for cooking over an open fire. Apparatus 10 generally comprises a handle 12, a first support 30, and a second support 40.

Handle 12 comprises a first end 14 and a second end 16, separated from first end 14 by a distance defined as handle length 18. It is preferable that handle length 18 be variable and, in order to facilitate this, handle 12 preferably comprises a first handle member 20 and a second handle member 22. First handle member 20 and second handle member 22 are telescopically constructed and arranged such that first handle member 20 fits concentrically within second handle member 22 in such a manner as to allow member 20 to be slid back and forth within member 22, thereby varying the length 18 of handle 12. It is envisioned that adding additional, telescopically disposed members would provide a potentially greater maximum handle length, or allow for a potentially shorter minimum handle length, or both.

Preferably, in order to maintain handle 12 at a certain length 18, second member 22 further comprises a plurality of holes 24, spaced apart at a predetermined interval, and aligned substantially parallel to the axis of handle 12. First member 20 preferably comprises an outwardly biased, inwardly displaceable protuberance 26, sized to fit within holes 24, such that when protuberance 26 is aligned beneath a hole 24, protuberance 26 pops into hole 24, thereby preventing first member 20 to slide relative to second member 22 until protuberance 26 is downwardly pressed by an operator.

First end 14 is constructed and arranged to accept a cooking platform 28, for placement of food thereon. Preferably, cooking platform 28 is removable from handle 12 such that a variety of different platforms 28 may be used. Examples of such platforms may include a cage, such as the one shown in FIG. 1, a skillet, a skewer, and the like.

Handle 12 is supported by a first support 30 and a second support 40. First support 30 comprises at least one, preferably two, legs 32. It is envisioned that legs 32 have pointed lower ends 34 to ease insertion into the ground. It is also envisioned that support 30 define an opening 35 defined on its lower end by a substantially horizontal cross member 36. Member 36 is preferably wide enough, and opening 35 large enough, to allow a user to press pointed ends 34 into the ground using his or her foot.

Support 30 has a top 37 to which a first handle holding mechanism 38 is attached. Mechanism 38 provides vertical support to handle 12 as it acts as a fulcrum when the apparatus 10 is fully assembled and in use. Therefore, mechanism 38 may simply comprise an upwardly opening, U-shaped bracket, sized to accept handle 12. However, as can be seen in the Figures, mechanism 38 preferably comprises a commercially available, resiliently biased clip spring. A clip spring provides more support and allows handle 12 to be snapped into place easily and removed by simply lifting handle 12 out of mechanism 38.

Second support 40 may be constructed and arranged like first support 30, but preferably comprises a telescoping support member 42, partially and concentrically housed in a hollow center body 44, and having a height adjustment mechanism 46 for fixing the variable support member at a predetermined height.

Height adjustment mechanism 46 preferably comprises a threaded bolt extending through center body 44 in such a manner that, when rotated, mechanism 46 presses against telescoping support member 42, holding it in place. Alternatively, a hole could extend through hollow center body 44 and a second set of holes, spaced apart at a predetermined interval, could extend through telescoping support member 42, so that a particular height could be selected by lining up the center body hole with one of the support member holes and passing a rod through both. It is also envisioned that a quick-release attachment, like those found commercially on bicycles for raising and lower a bicycle seat, be used to adjust the height of the telescoping support member. Other mechanisms for allowing an adjustable height are known to those skilled in the art and would be acceptable substitutions for those described herein without departing from the spirit of the invention.

The embodiment of second support 40, which is shown in the Figures, includes a plurality of legs 48, preferably three, radiating from center body 44. Legs 48 are angularly separated by interior angles $\alpha$, $\beta$, and $_{y}$. Angles $\alpha$, $\beta$, and $_{y}$ are preferably at least 60° each, more preferably on the order of 120° each.

A second handle holding mechanism 50 is attached to the top of telescoping support member 42. Second handle holding mechanism 50 is preferably a resiliently biased mechanism, similar to mechanism 38 of the first support 30. Alternatively, because the second handle holding mechanism 38 will be required to exert a downward force on the handle, especially when cooking platform 28 is weighted down with food, thereby causing handle 12 to become a lever and first support 30 to act as a fulcrum, second handle holding mechanism 50 could comprise a downwardly opening bracket, attached at upper end 52 of member 42.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An open fire cooking apparatus comprising:

a cooking platform for supporting food items directly over the open fire;

a handle removably attached to said cooking platform, said handle having a first end proximate said cooking platform and a second, distal end opposite send cooking platform, said handle ends separated by a distance defined as the handle length;

a first support comprising at least one leg and a resiliently biased handle holding mechanism constructed and arranged to engage the handle at a first location proximate the first end thereof, for removably and rotatably holding said handle; and, a second support comprising at least one leg and a resiliently biased handle holding mechanism constructed and arranged to engage the handle at a second location thereon proximate the handle second end, for removably and rotatably holding said handle.

2. The apparatus of claim 1 wherein said handle further comprises at least two members telescopically constructed and arranged to provide a range of handle lengths.

3. The apparatus of claim 1 wherein said at least one first support leg further comprises a pointed lower end for allowing said leg to be inserted into the ground.

4. The apparatus of claim 1 wherein said handle further comprises a generally circular cross section, allowing for ease of rotation within said handle holding mechanisms.

5. The apparatus of claim 1 wherein at least one of said supports further comprises a height adjustment mechanism for varying the distance between the handle holding mechanism and the ground.

6. The apparatus of claim 1 wherein said first support further comprises two spaced apart legs connected by a substantially horizontal cross member, each of said legs having a pointed lower end for easing insertion of said pointed lower end into the ground.

7. The apparatus of claim 1 wherein said second support member further comprises:

a hollow center body;

a telescoping support member, a portion of which is generally concentrically and slidably housed within said center body, the support member having an upper end, the upper end carrying said resiliently biased handle holding mechanism; and, three angled legs radiating outwardly and downwardly from said support member, said legs spaced apart from each other by an angle of at least 20 degrees.

8. The apparatus of claim 1 wherein at least one of said resiliently biased handle holding mechanisms comprises a spring clip.

9. The apparatus of claim 7 wherein said second support member further comprises a tightening mechanism for releasably securing said telescoping support member within said hollow center body so that a predetermined portion of said telescoping support member is housed with said center body.

* * * * *

UNITED STATES PATENT AND TRADEMARK OFFICE

CERTIFICATE OF CORRECTION

PATENT NO. : 6,234,162 B1
DATED : May 22, 2001
INVENTOR(S) : Wenker, David Allen It is certified that error appears in the above-identified patent and that said Letters Patent is hereby corrected as shown below:

Column 4,
Line 15, delete the word "send" and insert the word -- said --.

Signed and Sealed this

First Day of October, 2002

*Attest:*

*Attesting Officer*

JAMES E. ROGAN
*Director of the United States Patent and Trademark Office*